US008849141B2

(12) United States Patent
Takeuchi

(10) Patent No.: US 8,849,141 B2
(45) Date of Patent: Sep. 30, 2014

(54) IMAGE FORMING APPARATUS THAT CONTROLS HEAT APPLICATION TO FIXING DEVICE

(75) Inventor: Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 124 days.

(21) Appl. No.: 13/426,755

(22) Filed: Mar. 22, 2012

(65) Prior Publication Data

US 2012/0263489 A1 Oct. 18, 2012

(30) Foreign Application Priority Data

Apr. 14, 2011 (JP) ..... 2011-089717

(51) Int. Cl.
*G03G 15/20* (2006.01)

(52) U.S. Cl.
CPC ..... *G03G 15/2039* (2013.01)
USPC ..... 399/69

(58) Field of Classification Search
USPC ..... 399/67, 69
See application file for complete search history.

(56) References Cited

U.S. PATENT DOCUMENTS 7,324,771 B2 * 1/2008 Lemaster et al. ..... 399/69
8,565,630 B2 * 10/2013 Kim et al. ..... 399/69
8,588,639 B2 * 11/2013 Takahashi et al. ..... 399/70
8,649,698 B2 * 2/2014 Namiki et al. ..... 399/70
2007/0217807 A1 * 9/2007 Maeda et al. ..... 399/69

FOREIGN PATENT DOCUMENTS

JP 06-130856 5/1994
JP 08-185081 7/1996
JP 2003-050517 2/2003

OTHER PUBLICATIONS

Translation of Tanaka, JP,2003-050517,A pub date: Feb. 21, 2003.*

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus includes a fixing device, a temperature sensor and a controller. The fixing device includes a heat source, a heat member heated by the heat source, and a back-up member. The temperature sensor detects a temperature of the heat member. The controller controls the heat source and includes an output determination unit determining an output at which the heat source is operated to generate a target temperature; a first setting unit setting a first target temperature; a second setting unit setting a second target temperature lower than the first target temperature; a switching unit switching the target temperature from the first target temperature to the second target temperature; a determination unit determining whether a recording sheet is conveyed; and a supplemental output control unit generating a supplemental output greater than the output if the recording sheet is conveyed when the target temperature is switched.

13 Claims, 6 Drawing Sheets

FIG.4

| DIFFERENCE(D) | DUTY RATIO | ON/OFF PATTERN |
|---|---|---|
| D ≦ 0°C | 0% | OFF |
| 0°C < D ≦ 5°C | 25% | ON OFF OFF OFF |
| 5°C < D ≦ 10°C | 33% | ON OFF OFF |
| 10°C < D ≦ 13°C | 50% | ON OFF |
| 13°C < D ≦ 20°C | 67% | ON ON OFF |
| 20°C < D ≦ 23°C | 75% | ON ON ON OFF |
| 23°C < D | 100% | ON |

IMAGE FORMING APPARATUS THAT CONTROLS HEAT APPLICATION TO FIXING DEVICE

CROSS REFERENCE TO RELATED APPLICATION

This application claims priority from Japanese Patent Application No. 2011-089717 filed Apr. 14, 2011. The entire content of the priority application is incorporated herein by reference.

TECHNICAL FIELD

The present invention relates to an image forming apparatus provided with a fixing device that thermally fixes a transferred developing agent image to a sheet.

BACKGROUND

A well-known electrophotographic image forming apparatus has a fixing device that thermally fixes a developer image to a sheet. There have been proposed methods for controlling a temperature of the fixing device. According to one of such methods, a temperature of a back-up roller of the fixing device is detected at certain intervals once a series of printing is initiated after a period of stand-by, and a temperature of a heat roller is controlled to decline in a phased manner each time the detected temperature reaches a predetermined temperature.

SUMMARY

However, in the above-described temperature controlling method, if a recording sheet enters between the heat roller and the back-up roller when output of a heat source becomes smaller in response to the gradually-lowered temperature of the heart roller, a temperature between the heat roller and the back-up roller may be caused to drop substantially because heat is drastically taken away by the recording sheet. This phenomenon is so called "undershoot".

In view of the foregoing, it is an object of the present invention to provide an image forming device capable of suppressing occurrence of undershoot.

In order to attain the above and other objects, there is provided an image forming apparatus configured to form an image on a recording sheet. The image forming apparatus includes a fixing device configured to thermally fix the image on the recording sheet, a temperature sensor and a controller. The fixing device includes: a heat source configured to generate an amount of heat; a heat member heated in accordance with the amount of heat applied from the heat source; and a back-up member providing a nip region for nipping the recoding sheet in cooperation with the heat member. The temperature sensor is configured to detect a temperature of the heat member. The controller is electrically connected to the heat source and the temperature sensor and is configured to control the heat source. The controller includes: an output determination unit configured to determine an output at which the heat source is operated to generate a target temperature, the output being determined by performing a prescribed calculation based on a difference between the target temperature and the temperature of the heat member detected by the temperature sensor, the target temperature being a temperature at which the heat member is to be heated; a first setting unit configured to set a first target temperature upon receipt of a print command; a second setting unit configured to set a second target temperature lower than the first target temperature; a switching unit configured to switch the target temperature from the first target temperature to the second target temperature when a prescribed condition is met; a determination unit configured to determine whether the recording sheet is being conveyed toward the nip region; and a supplemental output control unit configured to generate a supplemental output greater than the output obtained from the prescribed calculation for performing supplemental heating to the heat member at least until the recording sheet reaches the nip region if the recording sheet is determined to be conveyed toward the nip region when the target temperature is switched from the first target temperature to the second target temperature.

BRIEF DESCRIPTION OF THE DRAWINGS

In the drawings:

FIG. 4 is a table used for determining the duty ratio according to the embodiment;

DETAILED DESCRIPTION

First, a general configuration of a laser printer 1 according to an embodiment of the present invention is described with reference to FIG. 1.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
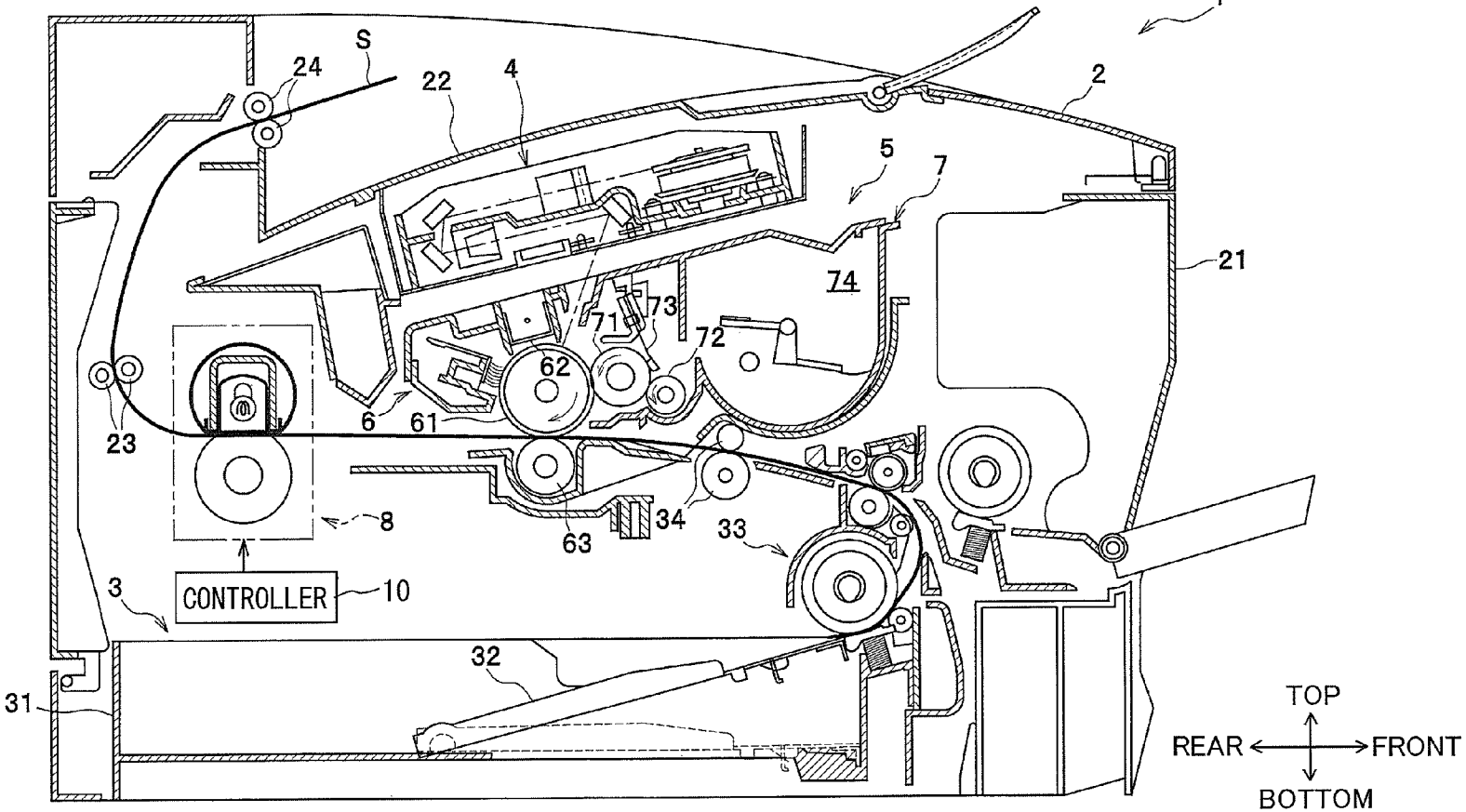
FIG. 1 is a schematic cross-sectional view illustrating a general configuration of a laser printer according to an embodiment of the present invention, the laser printer being provided with a fixing device.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and a fixing device 8 for thermally fixing the toner image onto the sheet S are provided. A controller 10 configured to control the operation of the fixing device 8 is also disposed suitably within the main frame 2.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet supplying mechanism 33 and a pair of registration rollers 34. Each sheet S accommodated in the sheet supply tray 31 is directed upward by the lifter plate 32, is supplied toward the process cartridge 5 by the sheet supplying mechanism 33, passes between the registration rollers 34 and is conveyed between a photosensitive drum 61 and a transfer roller 63. A path along which the sheet S is conveyed within the main frame 2 (sheet conveying path) is shown by a thick solid line in FIG. 1.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data so. A surface of the photosensitive drum 61 is therefore exposed to light by the high speed scan of the laser beam.

The process cartridge 5 is disposed below the exposure unit 4. The process cartridge 5 is detachably loadable in the main frame 2 through a front opening defined when the front cover 21 of the main frame 2 is opened. The process cartridge 5 includes a drum unit 6 and a developing unit 7.

The drum unit 6 includes the photosensitive drum 61, a charger 62, and the transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developer) is accommodated.

In the process cartridge 5, after the surface of the photosensitive drum 61 is uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 and is carried on the developing roller 71 as a thin layer having a uniform thickness.

The toner borne on the developing roller 71 is supplied to the electrostatic latent image formed on the photosensitive drum 61, thereby forming a visible toner image on the surface of the photosensitive drum 61. Then, the sheet S is conveyed between the photosensitive drum 61 and the transfer roller 63, so that the toner image formed on the photosensitive drum 61 is transferred onto the sheet S.

The fixing device 8 is disposed rearward of the process cartridge 5. The toner image (toner) transferred onto the sheet S is thermally fixed on the sheet S while the sheet S passes through the fixing device 8. The sheet S on which the toner image is thermally fixed is then conveyed by conveying rollers 23, 24 and is discharged onto a discharge tray 22 formed on an upper surface of the main frame 2.

Next, a detailed structure of the fixing device 8 will be described with reference to FIG. 2.

Figure 2:
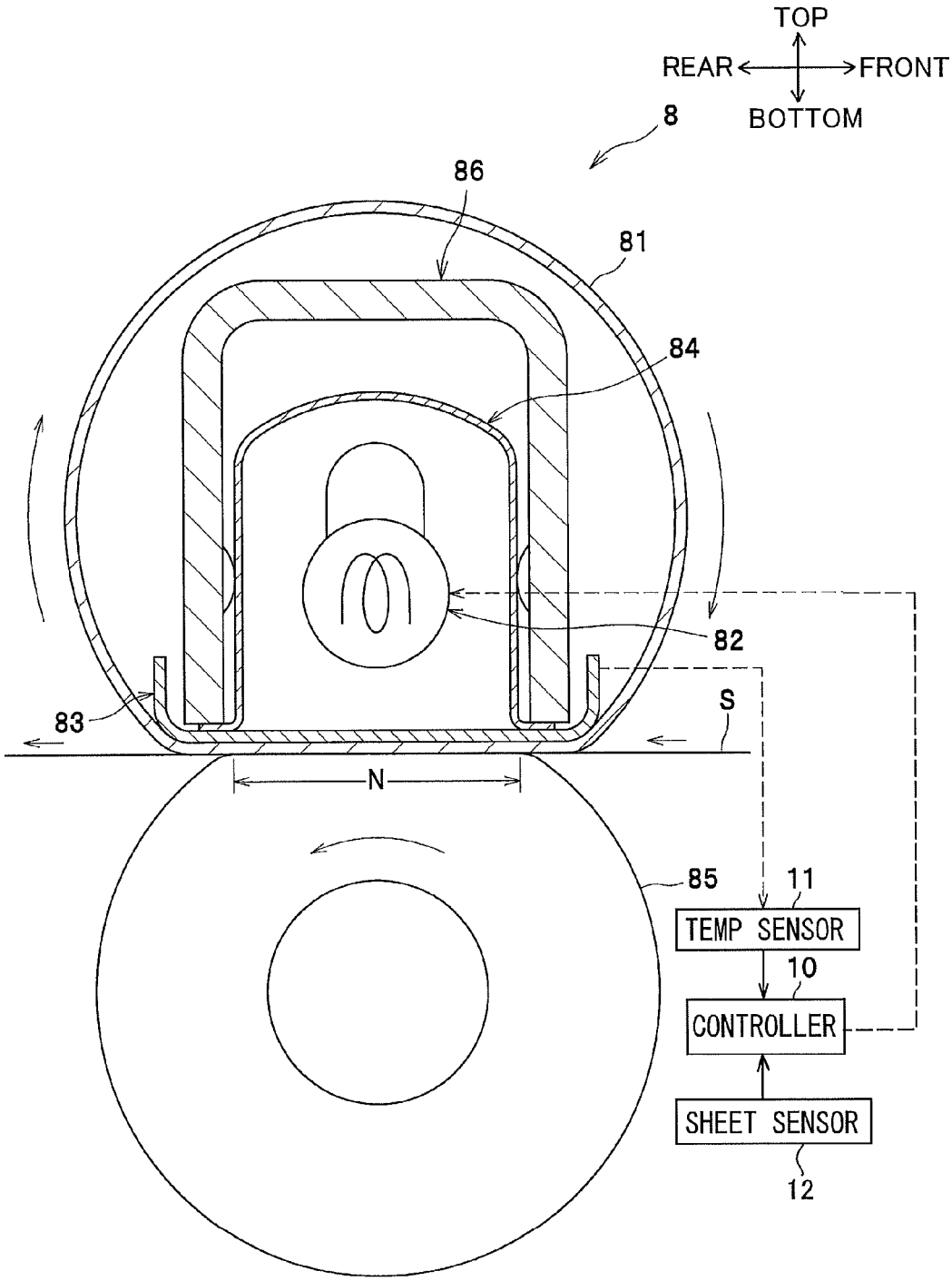
FIG. 2 is a schematic cross-sectional view illustrating a general configuration of the fixing device, the fixing device being electrically connected to a temperature sensor, a controller and a sheet sensor provided within the laser printer.

As shown in FIG. 2, the fixing device 8 includes a tubular fusing film 81, a halogen lamp 82 as a heat source, a nip plate 83 as a heating member, a reflection plate 84, a pressure roller 85 as a back-up member and a stay 86.

In the following description, a direction in which the sheet S is conveyed (a front-to-rear direction) will be simply referred to as a sheet conveying direction.

The fusing film 81 is of an endless film (of a tubular configuration) having heat resistivity and flexibility. The fusing film 81 has an internal space within which the halogen lamp 82, the nip plate 83, the reflection plate 84 and the stay 86 are disposed. The fusing film 81 has widthwise end portions that are guided by guide members (not shown) so that the fusing film 81 is circularly movable. The fusing film 81 may be a metal film or a resin film. Alternatively, the fusing film 81 may be a film whose outer circumferential surface is coated with a rubber.

The halogen lamp 82 is configured to generate radiation heat for heating the nip plate 83 and the fusing film 81 (a nip region N) such that the toner on the sheet S can be heated. The halogen lamp 82 is positioned at the internal space of the fusing film 81 such that the halogen lamp 82 is spaced away from an inner surface of the nip plate 83 by a predetermined distance.

The nip plate 83 is a plate-shaped member and is heated by the radiation heat from the halogen lamp 82. The nip plate 83 is positioned such that an inner circumferential surface of the fusing film 81 is slidably movable with a lower surface of the nip plate 83. The nip plate 83 transmits the radiation heat from the halogen lamp 82 to the toner on the sheet S via the fusing film 81.

The reflection plate 84 is adapted to reflect the radiant heat from the halogen lamp 82 (the radiant heat mainly radiated frontward, rearward and upward) toward the nip plate 83. As shown in FIG. 2, the reflection plate 84 is positioned within the fusing film 81 and surrounds the halogen lamp 82, with a predetermined distance therefrom. Thus, heat from the halogen lamp 82 can be efficiently concentrated onto the nip plate 83 to promptly heat the nip plate 83 and the fusing film 81.

The pressure roller 85 nips the fusing film 81 in cooperation with the nip plate 83 to provide the nip region N for nipping the sheet S between the pressure roller 85 and the fusing film 81. The pressure roller 85 is disposed below the nip plate 83. The pressure roller 85 is rotationally driven by a drive motor (not shown) disposed in the main frame 2. By the rotation of the pressure roller 85, the fusing film 81 is circularly moved along the nip plate 83 because of the friction force generated between the pressure roller 85 and the sheet S, and between the sheet S and the fusing film 81. The toner image on the sheet S can be thermally fixed thereon by heat and pressure applied while the sheet S passes between the pressure roller 85 and the fusing film 81 (the nip region N).

The stay 86 is adapted to support the nip plate 83 via the reflection plate 84. The stay 86 receives pressure (load) applied from the pressure roller 85. The stay 86 is disposed at the internal space of the fusing film 81 such that the stay 86 covers the reflection plate 84. For fabricating the stay 86, a highly rigid member such as a steel plate is folded into a shape (having a substantially U-shaped cross-section) in conformance with an outer profile of the reflection plate 84.

In the fixing device 8, the toner image transferred on the sheet S is thermally fixed thereon while the sheet S passes the nip region N (between the fusing film 81 (nip plate 83) and the pressure roller 85).

Next, how the controller 10 controls operations of the fixing device 8 will be described with reference to FIGS. 3 to 6.

As shown in FIG. 2, the laser printer 1 further includes, within the main frame 2, a temperature sensor 11 and a sheet sensor 12.

The temperature sensor 11 is a well-known sensor configured to detect a temperature of the nip plate 83. Note that, here, the temperature sensor 11 may detect the temperature of the nip plate 83 directly or indirectly. For example, the temperature sensor 11 may detect the temperature of the nip plate 83 by detecting a temperature of the fusing film 81 or the pressure roller 85. The temperature detected by the temperature sensor 11, which will be referred to as a "detected temperature" hereinafter, is then outputted to the controller 10.

The sheet sensor 12 is a sensor configured to detect whether there is a sheet S that is being conveyed toward the fixing device 8 (the nip region N). The sheet sensor 12 may be configured of, for example, an actuator that pivotally moves when the conveyed sheet S is in abutment therewith and a light sensor that detect pivotal movement of the actuator. Although not shown in the drawings, the sheet sensor 12 is disposed on the sheet conveying path (shown in thick solid line in FIG. 1) at a position between the registration rollers 34 and the photosensitive drum 61. The sheet sensor 12 outputs its detection result to the controller 10.

Figure 3:
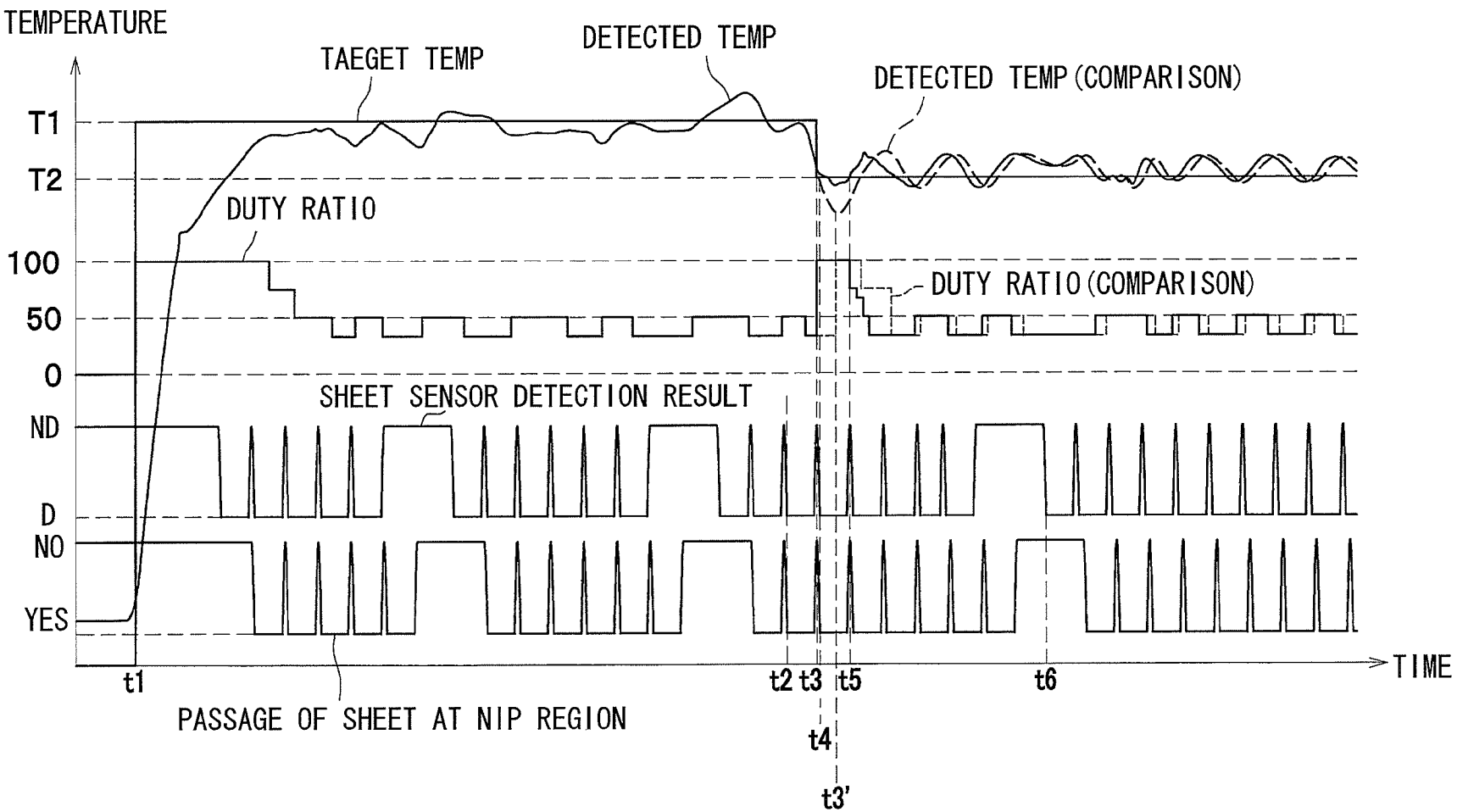
FIG. 3 is a time chart illustrating changes in a target temperature, a detected temperature, a duty ratio, a detection result of the sheet sensor, and passage of sheet at the fixing device according to the embodiment.

In FIG. 3, D represents a state where the sheet sensor 12 detects that the sheet S is currently being conveyed, while ND represents a state where the sheet sensor 12 does not detect passage of the sheet S. Similarly, YES represents a state where the sheet S has passed the nip region N, whereas NO represents a state where the sheet S does not pass the nip region N.

The controller 10 controls outputs of the halogen lamp 82 for controlling operations of the fixing device 8. The controller 10 includes a CPU, a RAM, a ROM and input-output circuits (all not shown). The controller 10 is configured to perform controls by executing various computations based on inputs from the temperature sensor 11 and the sheet sensor 12, print commands, and programs and data stored in the ROM.

Specifically, the controller 10 of the present embodiment is configured to mainly execute following control operations: a normal heating control operation and a supplemental heating control operation.

<Normal Heating Control Operation>

In the normal heating control operation, the controller 10 determines a target temperature, and controls the output of the halogen lamp 82 based on a difference between the target temperature and the detected temperature (to be referred to as a difference D, a target temperature TT and a detected temperature DT, respectively, whenever appropriate).

The target temperature is set in accordance with operation modes of the laser printer 1, such as an image forming mode in which a temperature of the nip region N is maintained at a temperature suitable for thermal fixation of toner, and a stand-by mode in which the temperature of the nip region N is maintained at a temperature lower than the temperature for thermal fixation. The controller 10 then determines the output of the halogen lamp 82 by executing prescribed computations based on the difference D between the target temperature TT and the detected temperature DT, which is equal to a value obtained by subtracting the detected temperature from the target temperature (D=TT−DT).

More specifically, the controller 10 determines a duty ratio from the difference (D) between the target temperature (TT) and the detected temperature (DT). Hereinafter, how the controller 10 controls the output of the halogen lamp 82 based on the duty ratio will be described, as an illustrative example, assuming that a print command (a command to start image formation) is inputted to the laser printer 1.

As shown in FIG. 3, when the print command is inputted at a time t1, the controller 10 first determines the target temperature (a first target temperature T1). The controller 10 then determines the duty ratio based on the difference between the target temperature and the detected temperature, using a table shown in FIG. 4. Based on the determined duty ratio, the controller 10 then controls power supply to the halogen lamp 82.

Specifically, referring to FIG. 4, when the difference (D) between the target temperature (TT) and the detected temperature (DT) is equal to or lower than 0 degrees (D≤0), the duty ratio is determined as 0%. When the difference between the target temperature and the detected temperature is more than 0 degrees but less than or equal to 5 degrees (0<D≤5), the duty ratio is determined as 25% from the table of FIG. 4. Likewise, when the difference between the target temperature and the detected temperature is more than 5 degrees but less than or equal to 10 degrees (5<D≤10), the duty ratio is determined as 33%. When the difference between the target temperature and the detected temperature is more than 10 degrees but less than or equal to 13 degrees (10<D≤13), the duty ratio is set to be 50%. When the difference between the target temperature and the detected temperature is more than 13 degrees but less than or equal to 20 degrees (13<D≤20), the duty ratio is set to be 67%. When the difference between the target temperature and the detected temperature is more than 20 degrees but less than or equal to 23 degrees (20<D≤23), the duty ratio is set to be 75%. When the difference between the target temperature and the detected temperature is greater than 23 degrees (23<D), the duty ratio is set to be 100%. Values and ON-OFF patterns shown in FIG. 4 are merely examples.

Figures 5A, 5B:
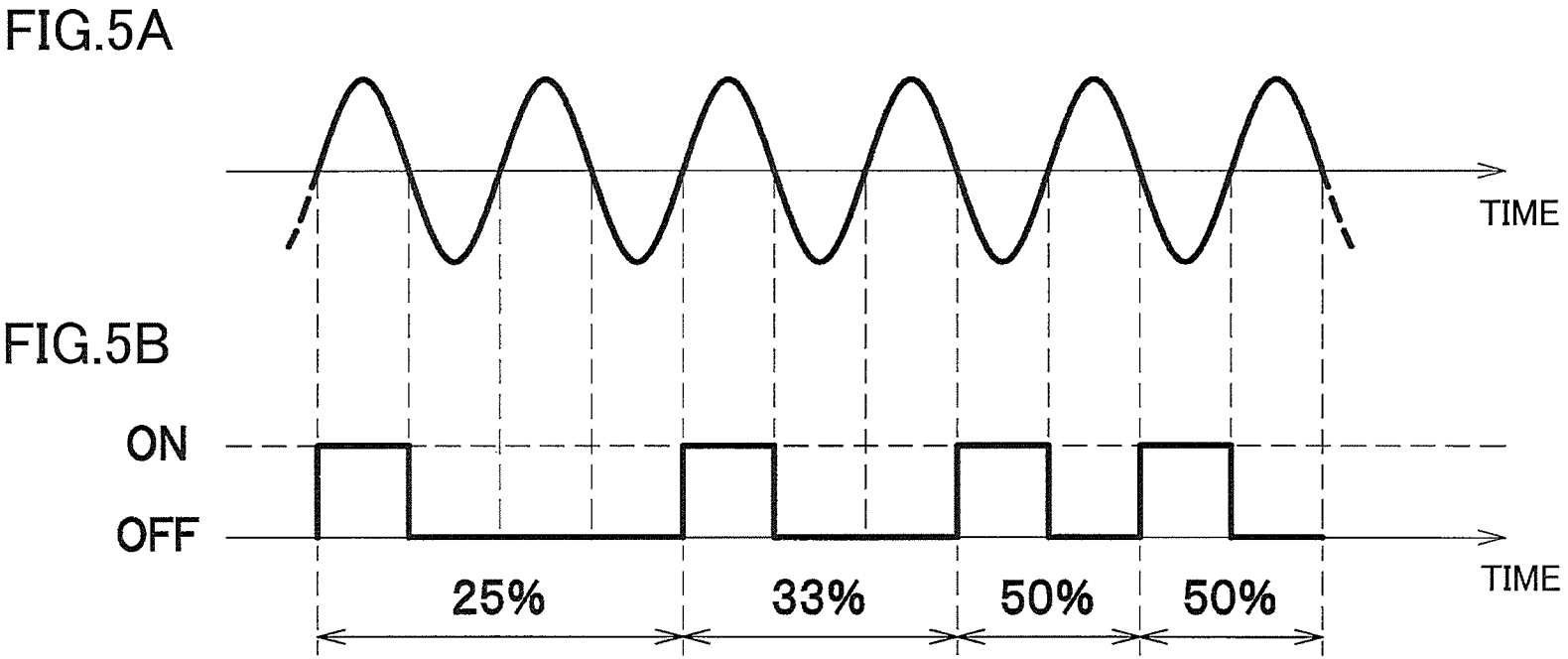
FIGS. 5A and 5B are views illustrating how the duty ratio is controlled according to the embodiment.

The controller 10 controls power supply to the halogen lamp 82 by switching ON and OFF an AC current supplied thereto, in accordance with the ON-OFF patterns associated with the determined duty ratio. More specifically, as shown in FIGS. 5A and 5B, the power supply to the halogen lamp 82 is switched between ON and OFF at every half of a sinusoidal waveform which is a waveform of the AC current (per each half sine). For example, if the duty ratio is 25%, the controller 10 treats four half sines (two cycles of the sinusoidal wave) as one control unit, and controls power supply to the halogen lamp 82 as ON, OFF, OFF, OFF per each half sine during a period of time corresponding to the one control unit.

Once finishing controlling the power supply for the one control unit, the controller 10 again determines the duty ratio. If the duty ratio is set to be 33%, the controller 10 then treats three half sines (one and a half cycles of the sinusoidal wave) as next one control unit, and controls power supply to the halogen lamp 82 as ON, OFF, OFF per each half sine during another period of time corresponding to the new one control unit. Further, when this power supply control is ended, the controller 10 again determines the next duty ratio. If the duty ratio is 50%, the controller 10 then treats two half sines (one cycle of the sinusoidal wave) as next one control unit and controls power supply to the halogen lamp 82 as ON, OFF per each half sine during a period of time corresponding to the current one control unit. In this way, thereafter, the controller 10 repeats to control the power supply to the halogen lamp 82 in accordance with the duty ratio determined each time.

As shown in FIG. 3, upon receipt of the print command at the time t1, the controller 10 sets the first target temperature T1, which is set to be higher than a second target temperature T2 (described next) in order to promptly heat the nip plate 83 (nip region N).

Then, the controller 10 switches the target temperature from the first target temperature T1 (high) to the second target temperature T2 (low) at a time t3 when a prescribed condition is met. In the present embodiment, this switching is configured to be executed when a predetermined period of time (40 seconds in the embodiment) has elapsed after the detected temperature reaches a prescribed temperature (100 degrees in the embodiment).

At this time when the target temperature is switched to the second target temperature T2 from the first target temperature T1 (at the time t3), the controller 10 determines whether there is a sheet S that is currently being conveyed toward the nip region N (between the nip plate 83 and the pressure roller 85). If the controller 10 determines that the sheet S is being conveyed toward the nip region N, the temperature sensor 11 performs the supplemental heating control operation.

The controller 10 makes this determination based on the input from the sheet sensor 12. Specifically, when the sheet sensor 12 detects that the sheet S has passed the sheet sensor 12 at a time t2 which is immediately before the time t3, the controller 10 determines that the sheet S is currently being conveyed toward the nip region N. On the other hand, if the sheet sensor 12 detects that no sheet S has passed at the time t2, the controller 10 determines that no sheet S is being conveyed toward the nip region N.

<Supplemental Heating Control Operation>

In the supplemental heating control operation, the controller 10 controls the halogen lamp 82 such that the output of the halogen lamp 82 is larger than the output determined from the above-described prescribed calculation during the normal heating control operation (more specifically, the output determined immediately before the time t3). More specifically, the controller 10 controls the power supply to the halogen lamp 82 at the duty ratio of 100% in the supplemental heating control operation.

The controller 10 executes the supplemental heating control operation for a prescribed period of time from the time t3 until a time t5 when a prescribed number of sheets S have passed the nip region N. In the present embodiment, only one sheet S is assumed to pass the nip region N for simplifying explanation. In other words, the controller 10 set the duty ratio to 100% during the supplemental heating control operation from the time t3 until the time t5 (this prescribed period of time corresponding to claimed third period of time).

Note that the period of time during which the prescribed number of sheets S has passed the nip region N may be detected by well-known methods and constructions: for example, by calculating from the detection results of the sheet sensor 12, or by detecting the sheet S at a sheet sensor (not shown) disposed downstream of the nip region N (the fixing device 8) in the sheet conveying direction. Here, detailed explanations are therefore omitted.

When a prescribed period of time has elapsed since the supplemental heating control operation is initiated (the prescribed period of time corresponding to claimed second period of time), the controller 10 is configured to control the power supply to the halogen lamp 82 such that the duty ratio becomes gradually smaller, for example, in the embodiment, from 100%, to 75%, then to 67% and then to 50% and so on. In the embodiment, the controller 10 starts to gradually reduce the duty ratio from the time t5, as shown in FIG. 3. That is, the controller 10 starts to reduce the duty ratio at the same time when the supplemental heating control operation is ended (the claimed second period of time and the claimed third period of time are identical to each other in the embodiment). The controller 10 then finally goes back to the normal heating control operation. This process of reducing the duty ratio is shown by a solid line in FIG. 3.

In other words, the controller 10 performs the supplemental heating control operation (at the duty ratio of 100%) until the single sheet S has passed the nip region N (until the time 5). After the time 5, the controller 10 does not immediately goes back to the normal heating control operation, but gradually makes the output of the halogen lamp 82 smaller to finally goes back to the normal heating control operation.

For comparison, suppose that the normal heating control operation is resumed immediately after the time t5. In this case, as shown by a broken line labeled "duty ratio (comparison)" in FIG. 3, since the difference between the target temperature (second target temperature T2) and the detected temperature is very small, the duty ratio may possibly be consequently set to be a smaller value, for example, 33% or 25%, which is much smaller than the duty ratio of 100% used until the time t5 during the supplemental heating control operation.

Here, for facilitating understanding, how the controller 10 performs the normal heating control operation and the supplemental heating control operation upon receipt of the print command will be described with reference to a flowchart of FIG. 6.

Figure 6:
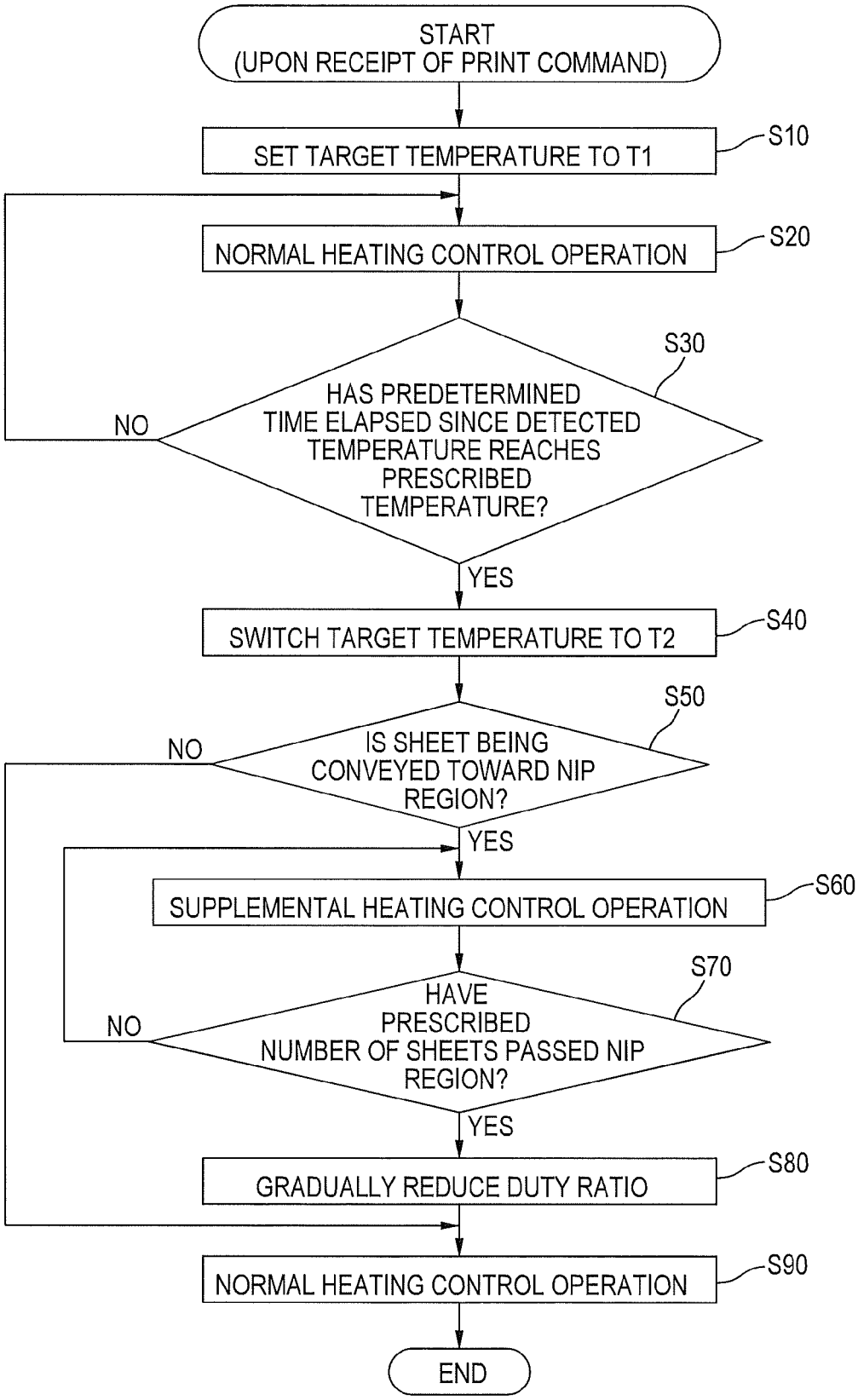
FIG. 6 is a flowchart explaining how the controller controls the fixing device according to the embodiment.

As shown in FIG. 6, when receives the print command at the time t1 of FIG. 3, the controller 10 sets the target temperature to the first target temperature T1 (S10). Subsequently, the controller 10 performs the normal heating control operation to control the output of the halogen lamp 82 (S20).

When the prescribed period of time has elapsed since the detected temperature becomes the predetermined temperature (when the predetermined condition is met) (S30: YES), the controller 10 then sets the second target temperature T2 as the target temperature (S40, at the time t3 in FIG. 3). At this time, the controller 10 determines whether any sheet S is being conveyed toward the nip region N (S50).

When there is any sheet S being conveyed to the nip region N (S50: YES), the controller 10 starts the supplemental heating control operation in S60 where the output of the halogen lamp 82 is controlled at the duty ratio of 100%. The controller 10 continues to maintain the duty ratio of 100% until the prescribed number of sheets S have passed the nip region N (S70: NO).

Once the prescribed number of sheets S have passed the nip region N (S70: YES, at the time t5 in FIG. 3), the controller 10 sets the duty ratio to be gradually smaller and controls the power supply to the halogen lamp 82 based on the continuously reduced duty ratio (S80). The controller 10 then moves back to the normal heating control operation in S90.

On the other hand, if there is no sheet S which is being conveyed toward the nip region N when the target temperature is switched from the first target temperature T1 to the second target temperature T2 (S50: NO), the controller 10 continues the normal heating control operation (S90) without performing the supplemental heating control operation.

When the print command has been processed (when the image forming mode is ended), the controller 10 may proceed to the stand-by mode where the normal heating control operation is performed at a target temperature lower than the second target temperature T2, or a sleep mode where the controller 10 shuts off the power supply to the halogen lamp 82 so that the temperature of the nip region N can be lowered to and maintained at an ambient temperature.

Here, for the sake of comparison, assume that the normal heating control operation is continued to be executed even after the target temperature has been switched to the second target temperature T2 at the time t3. That is, the supplemental heating control operation is not performed even after the time t3. As shown by broken lines of FIG. 3 (see broken lines labeled "the duty ratio (comparison)" and "detected temperature (comparison)" in FIG. 3), even when the target temperature has been switched from the first target temperature T1 to the second target temperature T2 at the time t3, the duty ratio is maintained at a relatively small value (at 33% in FIG. 3) since the difference between the target temperature (T2) and the detected temperature is very small. Therefore, the output of the halogen lamp 82 becomes also smaller.

In this state, when the sheet S enters into the nip region N (at a time t4), the sheet S takes the heat applied to the nip region N away therefrom drastically since an amount of heat applied to the nip region N has been smaller (i.e., undershoot could occur). The detected temperature consequently drops substantially at a time t3'. As the detected temperature falls, the difference between the target temperature (T2) and the detected temperature becomes large enough to cause the duty ratio to be changed to a higher value (100% in case of FIG. 3). As a result, the output of the halogen lamp 82 becomes greater, and the detected temperature (the temperature at the nip region N) starts to gradually rise after the time t3'. However, around the time t3', since the temperature of the nip region N could drop substantially, there remains a possibility that heat necessary for thermal fixation of the toner on the sheet S may not be applied to the toner.

According to the supplemental heating control operation of the present embodiment, on the other hand, at the time t3 when the target temperature is switched to the second target temperature T2 from the first target temperature T1, the output of the halogen lamp 82 is set to become greater (the duty ratio 100%) beforehand if the sheet S is to be conveyed toward the nip region N. Hence, even when the sheet S enters the nip region N at the time t4 and thereafter, a significant drop in the temperature of the nip region N can be suppressed from being caused.

It should be noted that, during the normal heating control operation and the supplemental heating control operation, the controller 10 according to the present embodiment is configured to control the output of the halogen lamp 82 to become smaller when any of the following conditions is met.

(Condition 1)

The controller 10 controls the output of the halogen lamp 82 to be small when the sheet sensor 12 detects that the sheet S is being conveyed toward the nip region N (more specifically, when the detection result of the sheet sensor 12 changes from ND to D (at the time t2 or at the time t6, for example)) but the sheet S does not arrive at the nip region N even after a predetermined period of time has passed since the passage of the sheet sensor 12. This predetermined period of time is set according to a size of the conveyed sheet S (corresponding to claimed fourth period of time). With this configuration, even if the sheet S is jammed upstream of the fixing device 8 in the sheet conveying direction, excessive increase in the temperature of the nip region N can be suppressed.

(Condition 2)

The controller 10 controls the output of the halogen lamp 82 to be small when the sheet S arrived at the nip region N does not leave the nip region N (the sheet S is continued to be nipped between the nip plate 83 and the pressure roller 85) even after a prescribed period of time has elapsed since the arrival at the nip region N. This predetermined period of time is set according to a size of the sheet S (corresponding to claimed fifth period of time). With this configuration, even if the sheet S is jammed at the fixing device 8, the temperature of the nip region N can be suppressed from rising too high.

Here, whether the sheet S has reached the nip region N and whether the sheet S remains at the nip region N can be detected by using well-known constructions or methods: for example, by detection results performed at a sheet sensor disposed adjacent to the fixing device 8 (immediately upstream or downstream of the fixing device 8 in the sheet conveying direction). Hence, a detailed explanation on how to detect availability of the sheet S at the fixing device 8 is omitted.

(Condition 3)

The controller 10 controls the output of the halogen lamp 82 to become small during execution of the normal heating control operation and the supplemental heating control operation, when the detected temperature goes up beyond a temperature higher a prescribed upper temperature limit of the nip region N. With his configuration, the temperature of the nip region N can be suppressed from rising too high.

Here, in the present embodiment, making the output of the halogen lamp 82 smaller means to include both of the following two cases: shutting down the power supply to the halogen lamp 82 (power OFF); and making the output (duty ratio) of the halogen lamp 82 smaller to the output (duty ratio) used when any of the above-described conditions is met.

As described above, the laser printer 1 of the present embodiment performs the supplemental heating control operation during which the output of the halogen lamp 82 is controlled to be higher than that determined during the normal heating control operation if the sheet S is detected to be conveyed toward the nip region N when the target temperature is switched. Hence, occurrence of undershoot (rapid fall in the temperature of the nip region N) when the sheet S enters the nip region N can be suppressed.

Further, the controller 10 of the present embodiment is configured to execute the supplemental heating control operation until the prescribed number of sheets S have passed the nip region N. Therefore, undershoot can be suppressed from occurring while the prescribed number of sheets S pass the nip region N of the fixing device 8.

Further, the controller 10 of the present embodiment is configured to control the amount of heat applied to the nip plate 83 such that the amount of heat is gradually reduced when a prescribed period of time (the claimed second period of time t5) has elapsed (at the time t5) since the supplemental heating control operation is started (at the time t3). Therefore, the output of the halogen lamp 82 can be prevented from becoming drastically too small after the time t5. In other words, the output of the halogen lamp 82 can be made greater for a while after the time t5, compared to a case where the output of the halogen lamp 82 is controlled according to the normal heating control operation even after the time t5. As a result, the occurrence of undershoot can be suppressed when the sheet S enters into the nip region N subsequently after the time t5.

Further, the controller 10 controls the duty ratio to be maintained at 100% for a prescribed period of time (the claimed third prescribed period of time, from the time t3 until the time t5) in the supplemental heating control operation. In other words, the output of the halogen lamp 82 can be maintained at its maximum level, and therefore undershoot can be suppressed from occurring.

Further, when there is a sheet S that is determined to be conveyed toward the nip region N, the controller 10 controls the output of the halogen lamp 82 to become smaller if the sheet S does not reach the nip region N even after a prescribed period of time (the claimed fourth period of time) has elapsed. Therefore, even in case that the sheet S gets jammed upstream of the fixing device 8 in the sheet conveying direction, the temperature of the nip region N can be suppressed from rising excessively high when the sheet S is jammed upstream of the fixing device 8 in the sheet conveying direction.

Further, the controller 10 controls the output of the halogen lamp 82 to become smaller when the sheet S remains at the nip region N even after a prescribed period of time (the claimed fifth period of time) has elapsed since the sheet S reaches the nip region N. Therefore, the temperature of the nip region N can be suppressed from elevating too high when the sheet S is jammed at the fixing device 8.

Further, during the normal heating control operation and the supplemental heating control operation, the controller 10 reduces the output of the halogen lamp 82 if the detected temperature exceeds the upper temperature limit predetermined for the nip region N. This configuration serves to suppress the temperature of the nip region N from rising too high.

Various modifications and changes are conceivable.

For example, the controller 10 of the embodiment is configured to execute the supplemental heating control operation from the time t3 when the target temperature has been switched until the time t5 when the prescribed number of sheets S have passed the nip region N. However, instead, the controller 10 may be configured to execute the supplemental heating control operation until the target temperature reaches the second target temperature T2. Alternatively, the controller 10 may be configured to execute the supplemental heating control operation for a predetermined fixed period of time, or for a period of time (corresponding to claimed first period of time) that is set each time based on information contained in a print command indicating that how many sheets are to be printed. Still alternatively, the controller 10 may be configured to execute the supplemental heating control operation until when the sheet S, which is determined to be conveyed toward the nip region N when the target temperature is switched, actually reaches the nip region N.

Further, the controller 10 of the embodiment is configured to go back to the normal heating control operation after the amount of heat applied to the nip plate 83 is gradually reduced after a prescribed period of time (the claimed second period of time) has elapsed from initiation of the supplemental heating control operation. However, the controller 10 may be configured to go back to the normal heating control operation immediately after the supplemental heating control operation is completed (for example, immediately after the sheet S passes between the nip plate 83 and the pressure roller 85).

Further, during the supplemental heating control operation (i.e., during the claimed third period of time (from the time t3 until the time t5)), the controller 10 maintains the duty ratio at 100% in the embodiment. However, the duty ratio may not necessarily be set to 100% provided that the halogen lamp 82 (heat source) can be operated at an output greater than that determined during the normal heating control operation (the output calculated based on the prescribed method). Still alternatively, the controller 10 may be configured to control the output of the halogen lamp 82 using a method other than controlling the duty ratio.

Further, in the embodiment, switching to the second target temperature T2 from the first target temperature T1 is configured to be executed when the predetermined period of time has elapsed since the detected temperature reaches the prescribed temperature. However, the switching may be configured to be carried out when a predetermined period of time has elapsed since the print command is received, or when the detected temperature becomes the prescribed temperature.

Further, the controller 10 is configured to determine whether there is any sheet S that is currently being conveyed toward the nip region N based on the detection result outputted from the sheet sensor 12. However, alternatively, the controller 10 may be configured to determine whether the sheet S is being conveyed toward the nip region N based on information contained in a print command indicative of on how many sheets image formation needs to be performed.

Further, instead of the halogen lamp 82 of the present embodiment, an infrared ray heater or a carbon heater is available as a heat source.

Instead of the nip plate 83 of the embodiment, the fusing film 81 of the embodiment may serve as the heat member. Further, a cylindrical-shaped member made from a metal such as aluminum (so called a heat roller) may also be used as the heat member.

In the depicted embodiment, the pressure roller 85 is employed as a back-up member. However, a belt like pressure member is also available.

Further, the sheet S can be an OHP sheet instead of a plain paper and a postcard.

Further, in the depicted embodiment, the present invention is applied to the monochromatic laser printer 1 as an example of image forming apparatus. However, a color laser printer, an LED printer, a copying machine, and a multifunction device are also available.

While the invention has been described in detail with reference to the embodiments thereof, it would be apparent to those skilled in the art that various changes and modifications may be made therein without departing from the spirit of the invention.

What is claimed is:

1. An image forming apparatus configured to form an image on a recording sheet, the image forming apparatus comprising:

a fixing device configured to thermally fix the image on the recording sheet, the fixing device comprising:

a heat source configured to generate an amount of heat;

a heat member configured to be heated in accordance with the amount of heat generated by the heat source; and a back-up member providing a nip region for nipping the recording sheet in cooperation with the heat member;

a temperature sensor configured to detect a temperature of the heat member; and a controller electrically connected to the heat source and the temperature sensor and configured to control the heat source by functioning as:

an output determination unit configured to determine an output at which the heat source is operated to generate a target temperature, the output being determined by performing a calculation based on a difference between the target temperature and the temperature of the heat member detected by the temperature sensor, the target temperature being a temperature at which the heat member is to be heated;

a first setting unit configured to set a first target temperature upon receipt of a print command;

a second setting unit configured to set a second target temperature lower than the first target temperature;

a switching unit configured to switch the target temperature from the first target temperature to the second target temperature when a prescribed condition is met;

a determination unit configured to determine whether the recording sheet is being conveyed toward the nip region;

a supplemental output control unit configured to generate a supplemental output, greater than the output obtained from the calculation, for performing supplemental heating of the heat member at least until the recording sheet reaches the nip region if the recording sheet is determined to be conveyed toward the nip region when the target temperature is switched from the first target temperature to the second target temperature; and an output reducing unit configured to gradually reduce the supplemental output back to the output obtained from the calculation when at least a second period of time has elapsed since the supplemental heating is initiated, the second period of time spanning from a time when the target temperature is switched from the first target temperature to the second target temperature to a time when the recording sheet has passed the nip region.

2. The image forming apparatus according to claim 1, wherein the supplemental output control unit is configured to execute the supplemental heating until a prescribed number of recording sheets have passed the nip region.

3. The image forming apparatus according to claim 1, wherein the supplemental output control unit is configured to execute the supplemental heating until the temperature of the heat member detected by the temperature sensor reaches the second target temperature.

4. The image forming apparatus according to claim 1, wherein the supplemental output control unit is configured to execute the supplemental heating for a predetermined fixed period of time.

5. The image forming apparatus according to claim 1, wherein the supplemental output control unit is configured to execute the supplemental heating for a first period of time, the first period of time being determined based on how many recording sheets are to be printed.

6. The image forming apparatus according to claim 1, wherein the output determination unit is configured to determine the output according to a duty ratio calculated based on the difference between the target temperature and the temperature of the heat member detected by the temperature sensor, and wherein the output determination unit is configured to set the duty ratio at 100 percent at least for a third period of time since the supplemental heating is initiated, the third period of time being a time span from a time when the target temperature is switched from the first target temperature to the second target temperature until a time when the recording sheet has passed the nip region.

7. The image forming apparatus according to claim 1, wherein the controller further comprises an output control unit configured to reduce one of the output and the supplemental output when the recording sheet fails to reach the nip region even if a fourth period of time has elapsed since the recording sheet is determined to be conveyed toward the nip region, the fourth period of time being determined based on a size of the recording sheet.

8. The image forming apparatus according to claim 1, wherein the controller further comprises an output control unit configured to reduce one of the output and the supplemental output when the recording sheet stays at the nip region after a fifth period of time has elapsed since the recording sheet reaches the nip region, the fifth period of time being determined based on a size of the recording sheet.

9. The image forming apparatus according to claim 1, wherein the heat member has a predetermined upper temperature limit up to which the heat member is to be heated, wherein the supplemental output control unit is further configured to reduce the supplemental output when the temperature of the heat member detected by the temperature sensor exceeds the predetermined upper temperature limit.

10. The image forming apparatus according to claim 1, wherein the switching unit is configured to switch the target temperature from the first target temperature to the second target temperature when a predetermined period of time has elapsed since the print command is received.

11. The image forming apparatus according to claim 1, wherein the switching unit is configured to switch the target temperature from the first target temperature to the second target temperature when the temperature of the heat member detected by the temperature sensor reaches a predetermined temperature.

12. The image forming apparatus according to claim 1, wherein the switching unit is configured to switch the target temperature from the first target temperature to the second target temperature when a predetermined period of time has elapsed since the temperature of the heat member detected by the temperature sensor reaches a predetermined temperature.

13. An image forming apparatus configured to form an image on a recording sheet, the image forming apparatus comprising:

a fixing device configured to thermally fix the image on the recording sheet, the fixing device comprising:

a heat source configured to generate an amount of heat;

a heat member configured to be heated in accordance with the amount of heat generated by the heat source; and a back-up member providing a nip region for nipping the recording sheet in cooperation with the heat member;

a temperature sensor configured to detect a temperature of the heat member; and a controller electrically connected to the heat source and the temperature sensor and configured to control the heat source to provide an image forming mode for performing an image forming operation, a stand-by mode initiated after image forming mode, and a sleep mode for shutting off power supply to the heat source, the controller configured to function as:

an output determination unit configured to determine an output at which the heat source is operated to generate a target temperature, the output being determined by performing a calculation based on a difference between the target temperature and the temperature of the heat member detected by the temperature sensor, the target temperature being a temperature at which the heat member is to be heated, the temperature of the heat member being maintained lower than a second target temperature during the stand-by mode;

a first setting unit configured to set a first target temperature upon receipt of a print command;

a second setting unit configured to set the second target temperature lower than the first target temperature;

a switching unit configured to switch the target temperature from the first target temperature to the second target temperature during the image forming mode;

a determination unit configured to determine whether the recording sheet is being conveyed toward the nip region; and a supplemental output control unit configured to generate a supplemental output, greater than the output obtained from the calculation, for performing supplemental heating of the heat member at least until the recording sheet reaches the nip region if the recording sheet is determined to be conveyed toward the nip region when the target temperature is switched from the first target temperature to the second target temperature lower than the first target temperature.

* * * * *